US005503565A

United States Patent [19]

McCoy

[11] Patent Number: 5,503,565

[45] Date of Patent: Apr. 2, 1996

[54] RECEPTACLE ASSEMBLY

[76] Inventor: Phillip A. McCoy, R.R. 1, Box 115, LaOtto, Ind. 46763

[21] Appl. No.: 91,320

[22] Filed: Jul. 14, 1993

[51] Int. Cl.[6] ..... H01R 29/00

[52] U.S. Cl. ..... 439/171; 439/211; 439/215

[58] Field of Search ..... 439/170, 171, 439/173, 188, 189, 207, 211, 215

[56] References Cited

U.S. PATENT DOCUMENTS

| | | | |
|---|---|---|---|
| 4,313,646 | 2/1982 | Millhimes et al. | 439/215 X |
| 4,367,370 | 1/1983 | Wilson et al. . | |
| 4,370,010 | 1/1983 | Ordmandy . | |
| 4,666,223 | 5/1987 | Tillmann . | |
| 4,740,167 | 4/1988 | Millhimes et al. . | |
| 4,775,328 | 10/1988 | McCarthy . | |
| 4,781,609 | 11/1988 | Wilson et al. . | |
| 4,952,164 | 8/1990 | French et al. . | |
| 4,985,806 | 1/1991 | Mazzullo et al. . | |
| 5,087,207 | 2/1992 | Byrne . | |
| 5,092,787 | 3/1992 | Wise et al. . | |
| 5,096,431 | 3/1992 | Byrne . | |
| 5,096,434 | 3/1992 | Byrne . | |
| 5,131,860 | 7/1992 | Bogiel . | |
| 5,171,159 | 12/1992 | Byrne . | |
| 5,203,711 | 4/1993 | Bogiel . | |
| 5,203,712 | 4/1993 | Kilpatrick et al. . | |
| 5,203,713 | 4/1993 | French et al. . | |

*Primary Examiner*—Khiem Nguyen
*Attorney, Agent, or Firm*—Barnes & Thornburg

[57] ABSTRACT

A receptacle assembly for multi-wire, multi-circuit power distribution systems for modular wall panels has a body, at least one outlet formed in the body, at least one input plug formed in the body, the input plug have a plurality of openings therein, and three conductors, one line conductor, one neutral conductor, and one ground conductor. The conductors extend from the outlet to the input plug. At least one of the three conductors terminates in a plurality of terminals positioned adjacent a respective plurality of input plug openings. A circuit selector clip engages one of these terminals so that the conductor is connected to one of a plurality of input circuits of the power distribution system. A first end of the clip has a female terminal that matingly engages one of a plurality of male terminals formed on a conductor that allows selective connection. Dimples may be formed on the first end to assure secure engagement with the male terminals. A second end of the clip has at least one pair of laterally opposed, biased fingers that are sprung toward one another to form a gap that slidingly and conductively receives therein a male terminal of an input circuit. Ends of the fingers may outwardly curve opposite one another and opposite the direction of bias of the fingers.

53 Claims, 4 Drawing Sheets

RECEPTACLE ASSEMBLY

BACKGROUND AND SUMMARY OF THE INVENTION

The present invention relates to a power distribution system for modular wall panels and particularly to outlet assemblies used in such systems. More particularly, the present invention relates to outlet assemblies for multi-wire, multi-circuit power distribution systems, having three conductors therein (one line conductor, one neutral conductor, and one ground conductor), where at least one of the line, neutral, and ground conductors within the receptacle can be selectively connected to one of the respective line, neutral, or ground wires of the power distribution system.

An office environment, as well as other work locations, often has several types of electrical and electronic equipment, such as computers, terminals, printers, photocopiers, fax machines, communication equipment, answering machines, heaters, air conditioners, etc. Each of these devices must be "plugged-in" to a circuit of a power distribution system. With multiple electronic equipment, multiple power, neutral, and ground lines are often needed to prevent overloading a single power line with too much current. Similarly, when multiple electronic devices share a common neutral, noise and/or current overload can occur because of lack of current cancellation due to phase shifting caused by inductive loads. "Clean" circuits having isolated grounds for powering of sensitive electronic equipment such as computers are also often needed because this equipment should not be connected in the same circuit where it can be exposed to current spikes or impulses caused by other electric equipment such as air conditioners and heaters.

The modern office environment often consists of a large open area or floor space that is divided into separate and distinct work areas via modular wall panel systems. These modular wall panels can be moved about with relative ease to change an entire office floor plan. This makes it difficult to set up electrical power distribution systems having the plurality of circuits often necessary for the reasons discussed above.

One solution to this problem has been achieved through the use of a plurality of connected, electrically prewired, modular wall panels that have power distribution components installed therein (often called wiring harnesses) that contain a plurality of power, neutral, and ground lines. Examples may include ten-wire systems that can contain such combinations as six power lines, two neutral lines, and two ground lines (one of which may be isolated) which define six different circuits, or four power lines, four neutral lines, and two ground lines (one of which may be isolated) which define four different circuits. A power or circuit tap, can be removably connected to a power distribution system within a modular wall panel to allow point of use connection. An example of a typical power or circuit tap would be the use of a plug-in outlet assembly that may be configured so as to draw power from one of a plurality of circuits in the power distribution system when a standard two-or three-prong electrical cord for an electrical device is inserted therein.

U.S. Pat. No. 4,367,370 to Wilson et al. shows a plug-in outlet receptacle for a five-wire power distribution system having three power lines, one neutral line, and one ground line, thus providing three separate circuits. The receptacle of Wilson et al. includes a switch that connects the receptacle to one of the three power lines via a sliding contact thereby selectively connecting the receptacle to one of the three circuits.

A disadvantage to the use of sliding contacts is that they add resistance, which becomes particularly problematic in environments where high amounts of current are needed. Also, sliding contacts may fail or gap, thus not providing electrical continuity. Finally, electrical sliding contacts add to the expense of constructing the outlet receptacle.

U.S. Pat. No. 4,775,328 to McCarthy discloses a plurality of ports that receive a plurality of plug-in outlet receptacle modules for a seven wire power distribution system having three power lines, two neutral lines, and two ground lines, to provide three separate circuits. Each of the ports has seven terminals that correspond to the seven lines of the power distribution system. In addition, each of the plug-in outlet receptacle modules has a differently configured set of three prongs that engage three of the seven terminals in a port to connect the receptacle to one of the three circuits. A disadvantage of this design is that a plurality of differently configured prongs must be formed for each outlet receptacle. This adds to the expense of the outlet receptacle. Another disadvantage is that a separate supply of outlet receptacles must be kept and located each time an outlet is to be connected to a different circuit. This requires separate stocking of these parts and is an inconvenience to the user.

U.S. Pat. No. 5,131,860 to Bogiel discloses a single plug-in outlet receptacle for a multi-circuit power distribution system. The plug-in outlet receptacle has three blade portions on one side thereof for interconnection with one of a plurality of circuit control modules that connect therewith. Each of the circuit control modules connects with three of the lines (one power, one neutral, and one ground) of the power distribution system to tap into one of its circuits. Each of the circuit control modules has three separately shaped blade portions (one for power, one for neutral, and one for ground). In addition, there are a plurality of circuit contacts mounted in each receptacle assembly that allow connection between three of the lines of the power distribution system and the circuit control module. Bogiel suffers from the same disadvantages as McCarthy. In addition, Bogiel has a plurality of circuit contacts further adding to both the cost and complexity of the design.

U.S. Pat. No. 5,096,431 to Byrne shows an outlet plug-in receptacle that has three internal terminals (one power, one neutral, and one ground) that can each be moved via slidable levers to selected positions for connection with three of a plurality of terminals in a junction block of a power distribution system. The terminals of the junction block are connected to the power, neutral, and ground wires of the power distribution system. This allows the receptacle to be selectably connected to any one of the plurality of circuits in the power distribution system. The three internal terminals of Byrne's receptacle are moved by physically bending the center and end portions thereof.

Byrne suffers from the disadvantage that the sliding assembly may fail. In addition, the sliding assembly adds to the cost of the outlet receptacle. Finally, Byrne's terminals are likely made from an expensive metal alloy because of the need for them to be both flexible and resilient. This too adds to the expense of the outlet receptacle.

Applicant makes no representation by this discussion, nor should any such representation be inferred, that an exhaustive search of all relevant prior art has been conducted, or that no more pertinent prior art exists.

An output plug-in receptacle that solves some or all of the above problems of added resistance, mechanical failure, high cost, required supply stocking, and design complexity would be a welcome improvement. Any new design improvement, however, should be easy to use and offer compatibility with existing systems.

Accordingly, a receptacle assembly is provided which has a body portion having at least one outlet formed therein for receiving an electrical plug. The outlet has a line terminal, a neutral terminal and a ground terminal. At least one input plug is formed in the body. The input plug has a plurality of openings therein. Conductors extending from the outlet terminals to the input plug are also provided. At least one of the conductors terminates in a plurality of terminals that are positioned adjacent a respective plurality of openings of the input plug. Finally, the receptacle assembly includes circuit selector means connected to one of the plurality of terminals adjacent the openings of the input plug. The circuit selector means selectively extends one of the terminals of the conductors into one of the plurality of openings of the input plug. In one embodiment of the present invention, each of the conductors terminates in a plurality of terminals positioned adjacent a respective plurality of openings formed in the input plug. In yet another embodiment of the present invention, the receptacle assembly has two input plugs formed on opposite ends of the body. The conductors extend from the outlet terminals of each of the input plugs such that at least one of the conductors terminates in a plurality of terminals adjacent a respective plurality of openings of at least one of the input plugs. In yet a further embodiment of the present invention each of the conductors terminates in two terminals adjacent two of the openings of the input plug.

The plurality of terminals on the end of the conductors may comprise male terminals. The circuit selector means may comprise a clip having a female terminal on a first end thereof adapted to matingly engage male terminals of the conductors. The first end of the circuit selector means may have anchoring means thereon for securely engaging the male terminals of the conductors. The anchoring means may comprise dimples formed in the first end. The first end may also be substantially U-shaped in cross-section.

The clip may also have a female terminal on a second end thereof adapted to matingly receive a male terminal of an input circuit. The female terminals of the first and second ends of the clip may be substantially orthogonally oriented relative to one another. The second end of the clip may comprise at least one pair of laterally opposed, biased fingers that are sprung toward one another to form a gap that slidingly and conductively receives therein the male terminal of the input circuit. The ends of these fingers may outwardly curve opposite one another and opposite the direction of the bias of the fingers.

The body of the receptacle assembly may have retaining means against which a portion of the first end of the clip may abut. This retaining means prevents the clip from being removed from a male terminal of a conductor on which the clip is matingly engaged when the second end of the clip matingly receives the male terminal of the input circuit. The retaining means may be a rib which may be formed on the body.

In this embodiment, the conductors may be made from either brass or copper and the circuit selector means may be made from high performance copper alloy.

Another embodiment of the receptacle assembly of the present invention includes at least one outlet formed for receiving an electrical plug. Input means for receiving a second electrical plug is provided with conductors connected to and extending from said outlet to said input means. The conductors terminate in a terminal adjacent the input means. Circuit selector means attached to said terminal for connecting said conductors to said input means is provided. The circuit selector means has a female terminal on a first end thereof adapted to matingly receive a male terminal of an input circuit. The input means may consist of a plurality of connection points in which case the conductors would terminate in a plurality of terminals positioned adjacent a respective plurality of the connection points. In such an embodiment the circuit selector means would be attached to one of the terminals.

The terminal of the conductors may comprise a male terminal in which case a second end of the circuit selector means would have a female terminal thereon adapted to matingly engage the male terminal of the conductors. The second end may have anchoring means thereon for securely engaging the male terminal of the conductors. The anchoring means may comprise dimples formed in a second end. The female terminals of the clip of this embodiment may be substantially orthogonally oriented relative to one another.

The female terminal on the first end may comprise at least one pair of laterally opposed biased fingers that are sprung toward one another to form a gap that slidingly and conductively receives therein the male terminal of the input circuit. The ends of the fingers may outwardly curve opposite one another and opposite the direction of the bias of the fingers.

In this embodiment, the conductors may be made from either brass or copper and the circuit selector means may be made from high performance copper alloy.

The receptacle assembly of the present invention may be configured for ten wire systems such as a "6-2-2 system" (a power distribution system having six lines, two neutrals, and two grounds) or a "4-4-2 system" (a power distribution system having four lines, four neutrals, and two grounds). An embodiment of the present invention for a "6-2-2 system" has a body with at least one outlet formed therein for receiving an electrical plug. At least one input plug is formed on the body. The input plug has six line openings, two neutral openings, and two ground openings. A line conductor is connected to and extends from the outlet to said input plug. The line conductor terminates in a plurality of terminals positioned adjacent a respective plurality of line openings. A neutral conductor is connected to and extends from the outlet to the input plug. The neutral conductor terminates in two terminals positioned adjacent the two neutral openings. A ground conductor is connected to and extends from the outlet to the input plug. The ground conductor terminates in two terminals positioned adjacent the two ground openings. Circuit selector means is connected to one of the plurality of terminals adjacent the line openings and connected to one of each of the two terminals adjacent both the neutral and ground openings. Circuit selector means selectively extends the line neutral and ground conductors into a selected one of the line, neutral, and ground openings. In one embodiment, three differently shaped line conductors are provided, each of which terminates in two terminals positioned adjacent two of the six line openings. In another embodiment, the receptacle assembly may include two input plugs formed on opposite ends of the body. In this embodiment, the line, neutral, and ground conductors are connected to and extend from the outlet to each of the input plugs, the line, neutral, and ground conductors each terminating in two terminals adjacent respective line, neutral, and ground openings of at least one of the input plugs.

The terminals of the line, neutral, and ground conductors may comprise male terminals. The circuit selector means may comprise clips having female terminals on the first ends thereof adapted to matingly engage the male terminals of the line, neutral, and ground conductors. The first ends of the clips may have anchoring means thereon for securely engaging the male terminals of the line, neutral, and ground conductors. The anchoring means may comprise dimples formed on the first ends of the clips. In addition, the first ends of the clips may be substantially U-shaped in cross-section.

The clips may have female terminals on second ends thereof adapted to matingly receive male terminals of an input circuit. In this embodiment, the female terminals on the first and second ends of each of the clips may be substantially orthogonally oriented relative to one another. The second ends of each of the clips may comprise at least one pair of laterally opposed, biased fingers that are sprung towards one another to form a gap that slidingly and conductively receives therein the male terminals of the input circuit. The ends of the fingers may outwardly curve opposite one another and opposite the direction of bias of the fingers.

An embodiment of the present invention for a "4-4-2 system" has a body with at least one outlet formed therein for receiving an electrical plug. At least one input plug is formed on the body. The input plug has four line openings, four neutral openings, and two ground openings. A line conductor is connected to and extends from the outlet to the input plug. The line conductor terminates in a plurality of terminals positioned adjacent a respective plurality of line openings. A neutral conductor is connected to and extends from the outlet to the input plug. The neutral conductor terminates in a plurality of terminals positioned adjacent a respective plurality of neutral openings. A ground conductor is connected to and extends from the outlet to the input plug. The ground conductor terminates in two terminals positioned adjacent two ground openings. Circuit selector means is connected to one of the plurality of terminals adjacent the line openings, one of the plurality of terminals adjacent the neutral openings, and one of the two terminals adjacent the ground openings. Circuit selector means selectively extends the line, neutral, and ground conductors into a selected one of the line, neutral, and ground openings. In one embodiment, there are two differently shaped line and neutral conductors each of which terminates in two terminals positioned adjacent two of the four respective line and neutral openings.

As with the "6-2-2 system", another embodiment of the receptacle assembly for the "4-4-2 system" may have two input plugs formed on opposite ends of the body. In this embodiment the line, neutral, and ground conductors are connected to and extend from the outlet to each of the input plugs, the line, neutral, and ground conductors each terminating in two terminals adjacent respective line, neutral, and ground openings of at least one of the input plugs.

The remaining characteristics of the "4-4-2 system", such as the shape of the terminals on the line, neutral, and ground conductors, the characteristics of the circuit selector means, etc. are the same as those discussed above with reference to the "6-2-2 system."

Other objects, advantages and novel features of the present invention will become apparent from the following detailed description of the invention when considered in conjunction with the accompanying drawings.

DETAILED DESCRIPTION OF THE DRAWINGS

Figure 1:
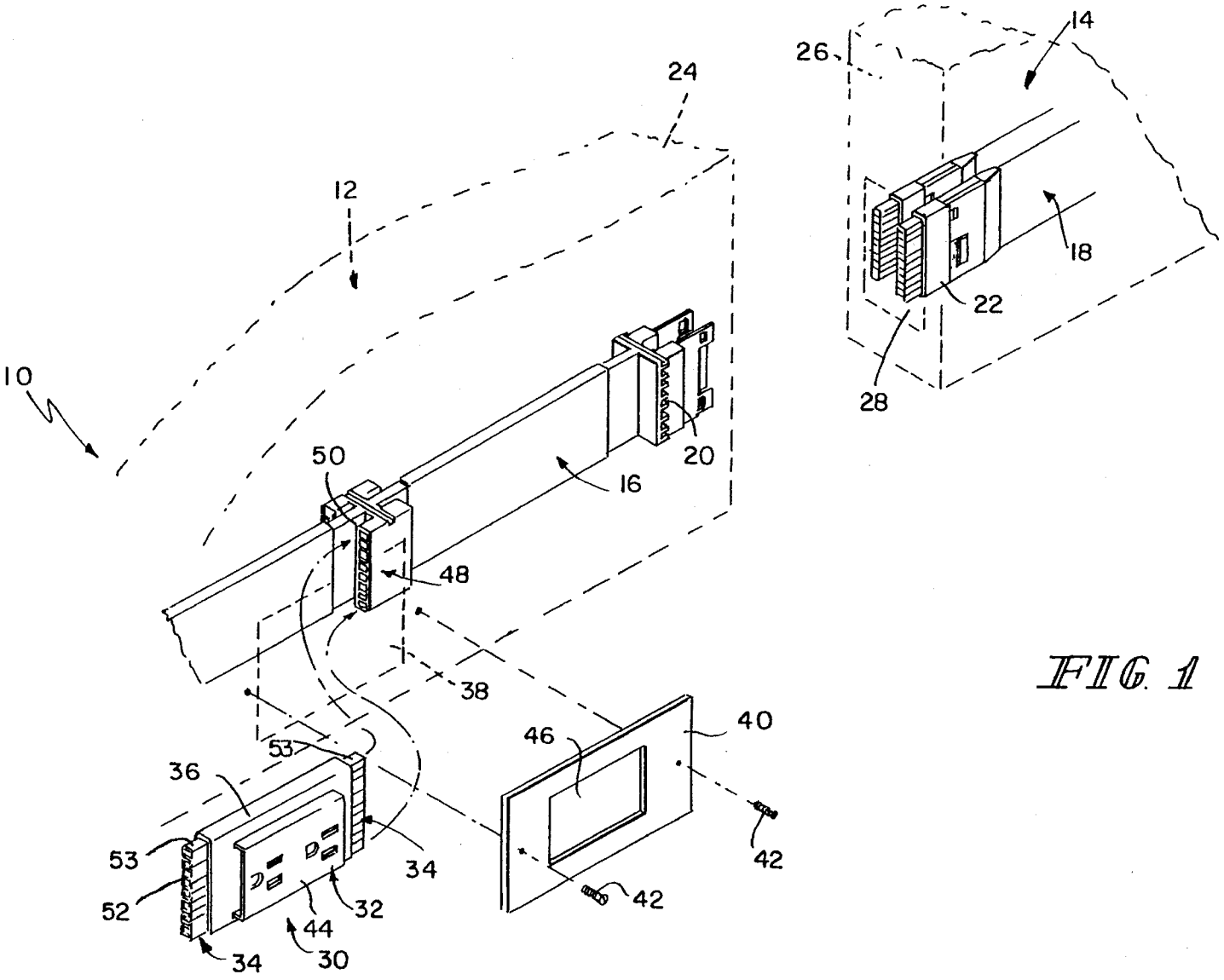
FIG. 1 is an exploded perspective view of a plug-in receptacle assembly, a receptacle cover plate, and portions of two wiring harnesses mounted inside movable walls.

FIG. 1 shows a power distribution system 10 mounted in modular wall panels 12 and 14. The power distribution system 10 is for the electrification of modular wall panels 12 and 14, such as those used in dividing a given area into separate work spaces. It should be understood, however, that the present invention is also equally useful and adaptable for environments and applications other than modular wall panel systems. Power distribution system 10 includes wiring harnesses 16 and 18 having a plurality of wires therein. In one embodiment, a ten-wire system has six power lines, two neutral lines, and two ground lines (one of which is an isolated ground) which provides six separate circuits, three circuits sharing one of the two neutral lines. In another embodiment, a ten-wire system has four power lines, four neutral lines, two ground lines (one of which is an isolated ground) which provides four separate circuits, each circuit having its own neutral line. While a ten-wire system utilizing "six-two-two" or "four-four-two" circuit configurations is shown, it is to be understood that the present invention is not so limited. Other systems and configurations are within the scope and spirit thereof.

End connectors 20 and 22 are shown on respective wiring harnesses 16 and 18. End connectors 20 and 22 are used to connect wiring harnesses 16 and 18 together via a plug-in connection when modular wall panels 12 and 14 are brought together so that the ends 24 and 26 thereof abut. Connection is made via openings in both ends 24 and 26. Note, in FIG. 1 only one opening 28 in modular wall panel 14 is shown.

Also shown in FIG. 1 is a plug-in receptacle assembly 30 constructed in accordance with the present invention. Receptacle assembly 30 has two outlets 32 which open onto one side thereof and input plugs 34 on both ends thereof. As can be seen in FIG. 1, outlets 32 are raised above face 36 of receptacle assembly 30. Outlets 32 are raised above face 36 so that when receptacle assembly 30 is placed in access opening 38 formed in modular wall panel 12 and removable cover 40 is inserted therein via screws 42, raised portion 44 extends through window 46 of removable cover 40.

As can further be seen in FIG. 1, outlet plug-in receptacle assembly 30 is connected to wiring harness 16 via receptacle connector 48. Receptacle connector 48 contains a plurality of openings 50 that correspond in number and shape to the number of hollow plug halves 52 and 53 (best shown in FIG. 2 discussed below) which form input plug 34 located on both ends of receptacle assembly 30. That is, receptacle connector 48 and input plug 34 are "keyed," as is known in the art, so that receptacle assembly 30 can only be connected at certain points in power distribution system 10.

Figure 2:
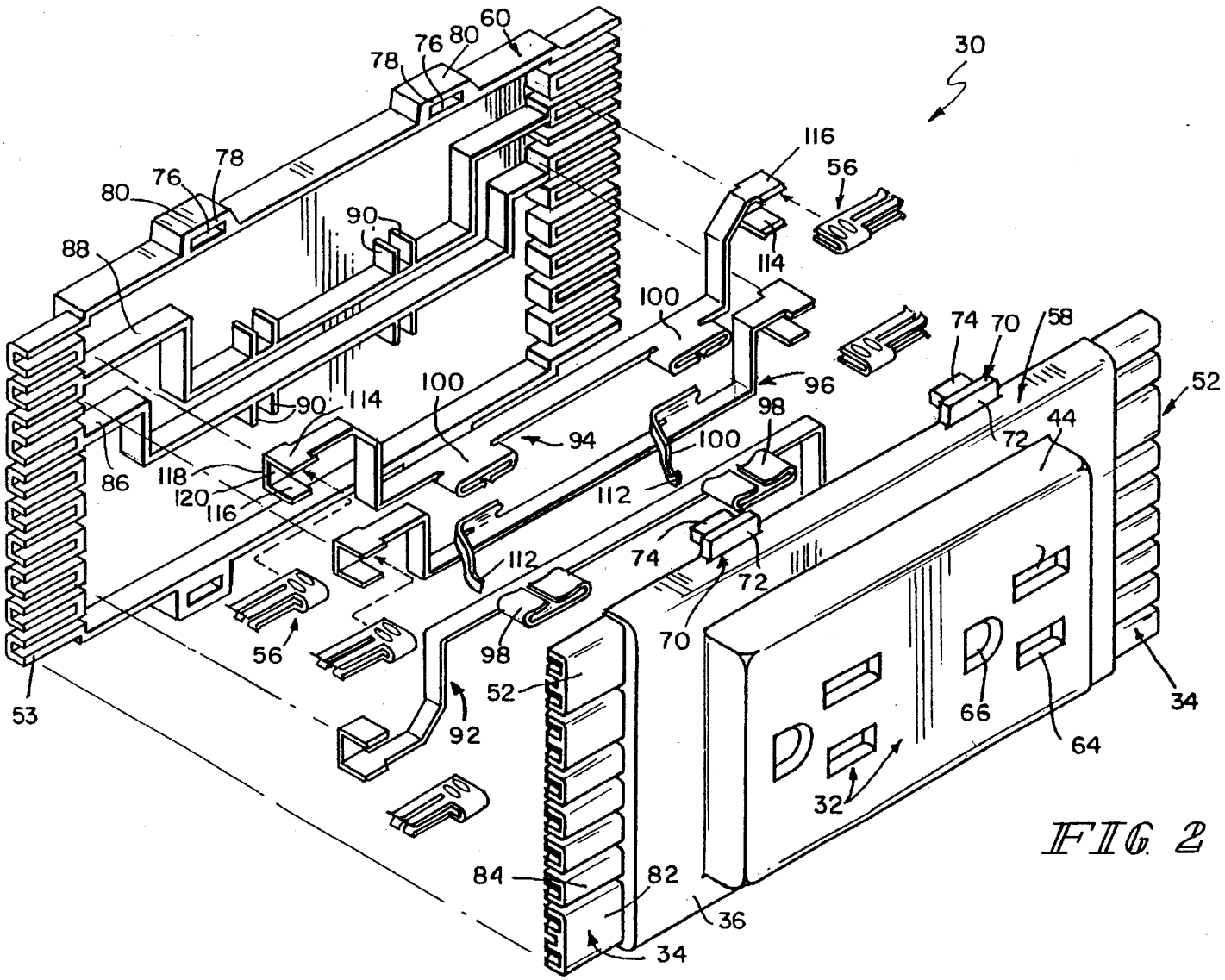
FIG. 2 shows an exploded perspective view of the receptacle assembly of FIG. 1.

An exploded perspective view of plug-in receptacle assembly 30, conductors 54, and conductive circuit selector clips 56 constructed in accordance with the present invention is shown in FIG. 2. As can be seen, plug-in receptacle assembly 30 has a body 58 and a cover 60. Outlets 32 are shown on raised portion 44 of body 58. Each of the outlets 32 shown in FIG. 2 has a power or line opening 64, a neutral opening 62, and a ground opening 66. As can be seen, line opening 64 is smaller than neutral opening 62. This size difference, coupled with the presence of ground opening 66, polarizes outlet 32. That is, a three-pronged plug of an electrical device can only be inserted so that the line, neutral, and ground prongs thereof are inserted in respective line, neutral, and ground openings (64, 62, and 66) of outlets 32. Furthermore, a two-pronged plug of an electrical device can only be inserted so that the line and neutral prongs thereof are inserted in respective line and neutral openings 64 and 62 of outlets 32. This prevents electrical devices from being incorrectly connected, for instance, the line prong being inserted in neutral opening 62 and the neutral prong being inserted in line opening 64 so as to avoid possible damage to the device. As can also be see from FIG. 2, ground opening 66 is substantially U-shaped. While the outlets 32 illustrated in the drawings are configured with standards utilized throughout the United States, it is to be understood that outlets 32 may be configured to correspond to other standardized receptacle configurations, including those utilized in other countries.

Body 58 includes an aligning and connecting structure 70 that includes raised portions 72 and tabs 74. Tabs 74 are designed to be received in holes 76 of cover 60 when body 58 and cover 60 are placed together around conductors 54 and circuit selector clips 56. This helps insure that body 58 and cover 60 are properly aligned. Raised portions 72 are designed to fit over faces 78 of raised portions 80 formed on cover 60. Body 58 and cover 60 are attached together via conventional methods in the art such as heat staking, ultrasonic welding, cementing, gluing, or other equivalent process.

The "keying" of input plug 34 formed by hollow plug halves 52 and 53 of respective body 58 and cover 60 can also be seen in FIG. 2. For example, plug half 82 is wider than plug half 84. As previously discussed, this allows receptacle assembly 30 to only be connected to particular receptacle connectors 48 at certain points in power distribution system 10.

Cover 60 is shown in FIG. 2 as having two barriers 86 and 88. Barriers 86 and 88 help physically and electrically isolate conductors 54 from one another. Conductors 54 need to be isolated so that they do not touch and cause a short in the circuit to which they are connected. Barriers 86 and 88 also provide structural strength along the length of cover 60. Barriers similar to those on cover 60 may also be provided on body 58. These barriers will be discussed in connection with FIG. 3 below. Cover 60 is also shown having hollow plug halves 53, discussed above, that correspond in number, size, and shape to plug halves 52.

Gussets 90 are shown extending substantially perpendicular to barriers 86 and 88 near the areas directly opposite where outlets 32 are located on body 58. Gussets 90 provide additional structural strength to cover 60 along a portion of the width thereof. Such additional strength, in conjunction with the structural strength provided by barriers 86 and 88, is provided to compensate for forces anticipated to be present near the location of gussets 90 when a plug of an electrical device is inserted in outlets 32. Gussets may also be provided on body 58 and will be discussed in connection with FIG. 3.

Conductors 54 shown in FIG. 2 include a power or line conductor 92, a neutral conductor 94, and a ground conductor 96. As can be seen, both line conductor 92 and neutral conductor 94 have respective sockets or terminals 98 and 100 that abut behind respective line and neutral openings 64 and 62 to receive the respective line and neutral prongs of a plug for an electrical device. Ground conductor 96 has tines or terminals 110 that extend therefrom. End portions 112 of tines 110 abut against ground prongs of electrical plugs inserted into ground openings 66 of outlets 32.

Two upstanding male terminals 114 and 116 can be seen located on the ends 118 of each of the respective line, neutral, and ground conductors 92, 94, and 96. Bridge 120 is shown connecting male terminals 114 and 116. Dashed lines in FIG. 2 between conductors 54 and circuit selector clips 56 illustrate how clips 56 can be selectively connected on either terminal 114 or terminal 116. This selective connection will be discussed below in more particularity with regard to FIGS. 5 and 6.

Figure 3:
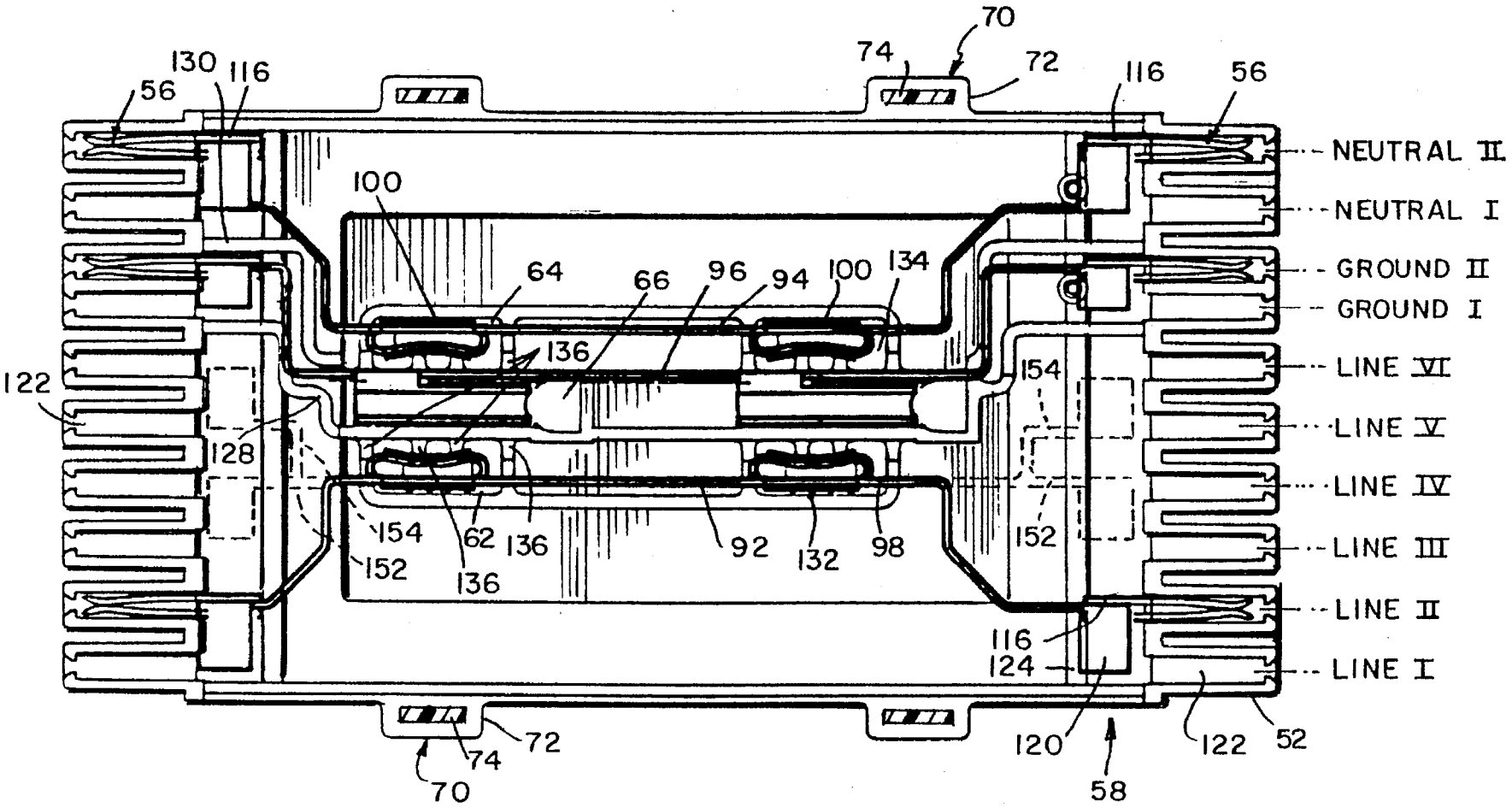
FIG. 3 shows a top view of the body half of the receptacle assembly of FIG. 1, with power, neutral and ground terminals disposed therein.

A top view of body 58 is shown in FIG. 3 with respective line, neutral, and ground conductors 92, 94, and 96 disposed therein. Circuit selector clips 56 are also shown, each connected to terminals 116. Bays 122 formed in hollow plug halves 52 are also shown. Portions of circuit selector clips 56 are shown as being disposed in six of these bays 122. Similar bays are provided in hollow plug halves 53 of cover 60 that receive another portion of clips 56.

Retaining ribs 124 are shown on opposing portions of body 58, extending the full width thereof. Ribs 124 are shown as being positioned adjacent circuit selector clips 56, terminals 114 and 116, and bridges 120. Ribs 124 are intended to prevent movement of clips 56 in the direction of the length of body 58 when a male terminal 126 (shown in FIG. 5) of receptacle connector 48 (also shown in FIG. 5) is inserted therein. While retaining rib 124 is shown as a single rectangular structure extending the full width of body 58, it is to be understood that other equivalent structure may be used.

Barriers 128 and 130 are also shown extending the full length of body 58. As discussed in connection with barriers 86 and 88 of FIG. 2, barriers 128 and 130 physically and electrically isolate conductors 54 from one another. Conductors 54 need to be isolated so that they do not touch and cause a short in the circuit to which they are connected. Barriers 128 and 130 also provide structural strength along the length of body 58 as discussed with regard to barriers 86 and 88. Barriers 128 and 130 in conjunction with raised portion 132 form a well 134 into which a portion of respective line, neutral, and ground conductors 92, 94, and 96.can be disposed.

Gussets 136 are also shown extending substantially perpendicular to barriers 128 and 130 near the areas where openings 98 and 100 are disposed in well 134. FIG. 3 shows four such gussets located near each of openings 98 and 100. It is to be understood, however, that any number of gussets or other equivalent structures may be used. Gussets 136 provide additional structural strength to body 58 along a portion of the width thereof. Such additional strength, in conjunction with structural strength provided by raised portion 132 and barriers 128 and 130, is provided to compensate for forces anticipated to be present near the location of respective line, neutral, and ground openings 64, 62, and 66 when a plug of an electric device is inserted in one of outlets 32.

Figure 4:
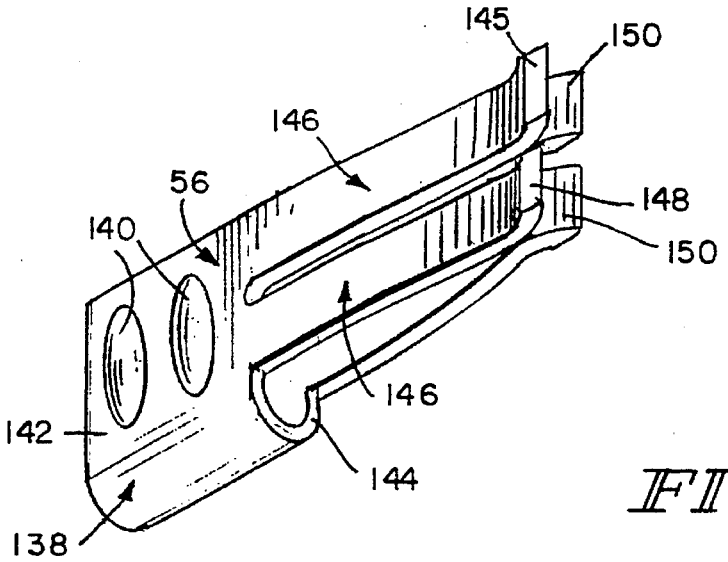
FIG. 4 shows a perspective view of a circuit selector clip constructed in accordance with the present invention.

FIG. 4 shows a perspective view of an electrically conductive circuit selector clip 56 constructed in accordance with the present invention. Circuit selector clip 56 includes a body 138 substantially U-shaped in cross-section so as to form a female clip. Body 138 is shown as having an anchoring structure consisting of dimples 140 on one side 142 thereof. Although not shown, dimples 140 are also present on side 144 of clip 56. Dimples 140 are indentations formed in sides 142 and 144 that aid in securely mounting and retaining clip 56 on either of terminals 114 and 116. Circuit selector clip 56 also has paired, laterally opposed, biased fingers 146 extending from body 138 that are sprung toward one another to form a gap that sliding and conductively receives therein male terminal 126 (shown in FIG. 5) of receptacle connector 48. While two pairs of fingers are shown in the drawings, it is to be understood that one or more pairs may be used. As can be seen in FIG. 4, opposing ends 148 and 150 of each of the pairs of fingers 146 outwardly curve opposite one another and opposite the direction of bias of fingers 146. Ends 148 and 150 provide guidance for the insertion of male terminal 126, as well as a positive, secure, contact for each of fingers 146 against terminal 126.

Circuit selector clip 56 is made from a metal alloy (such as high performance copper alloy) that is relatively expensive compared to the metal (such as brass, copper, or equivalent material) from which conductors 54 may be constructed. Clip 56 is preferably constructed from such an alloy because of flexing and resiliency requirements that must be maintained for fingers 146 throughout the life of the use of clip 56. However, this is one of the advantages of the present invention over some conventional one-piece designs. That is, only circuit selector clips 56 are constructed from a relatively expensive metal alloy. Conductors 54, on the other hand, can be made from one of the less expensive metals listed above. This cost savings can be significant in that clips 56 are significantly smaller than conductors 54 and, thus, require significantly less material.

With reference again to FIG. 3, another one of the advantages of the present invention will be discussed. As discussed above, receptacle assembly 30 as shown in the drawings is configured for a ten-wire system. Such ten-wire system configurations might include six line conductors, two neutral conductors, and two ground conductors (a "6-2-2 system") for a total of six circuits. Alternatively, the system may include four line conductors, four neutral conductors, and two ground conductors (a "4-4-2 system") for a total of four circuits. Receptacle assembly 30 shown in both FIGS. 2 and 3 is configured for a "6-2-2 system." As such there are a total of three line conductors, one neutral conductor 94, and one ground conductor 96). Only line conductor 92 is shown disposed within receptacle assembly 30. However, FIG. 3 shows two additional differently shaped line conductors 152 and 154 in dashed lines. Line conductors 152 and 154 could be alternatively installed in receptacle assembly 30 in place of line conductor 92 to connect with different circuits as discussed below. FIG. 3 also diagrammatically shows ten wires of a "6-2-2 system." As can be seen, six line wires, Lines I–VI, two ground wires, Grounds I–II, and two neutral wires, Neutrals I and II are shown. These wires could form six separate circuits by having Lines I–III each share Neutral I and Ground I for three separate circuits and by having Lines IV–VI each share Neutral II and Ground II for three additional separate circuits. It should be noted, however, that other combinations to form six separate circuits are possible. Connection to one of the six circuits is made by mating engagement of three of clips 56, disposed on one of the three line conductors 92, the neutral conductor 94, and the ground conductor 96, with three male terminals 126, connected to three of the ten wires of receptacle connector 48.

As can be seen in FIG. 3, line conductor 92 allows selective connection to either Line I or Line II. Line conductor 92 is shown in FIG. 3 as being able to be connected to Line II via engagement of circuit selector clip 56 on terminal 116. Line conductor 152, shown in dashed lines in FIG. 3, allows selective connection to either Line III or Line IV. As can be seen, line conductor 152 is differently shaped than line conductor 92 but still terminates in two male terminals 114 and 116. Connection to either Line III or Line IV can be achieved via respective placement of circuit selector clip 56 on either terminal 114 or 116. Line conductor 154 is also shown in dashed lines in FIG. 3. Line conductor 154 allows selective connection to either Line V or Line VI. Line conductor 154 is differently shaped than either line conductor 92 or 152. However, line conductor 154 also terminates in two terminals 114 and 116. Connection to either Line V or Line VI can be achieved via respective placement of circuit selector clip 56 on either terminal 114 or 116. FIG. 3 also shows that neutral and ground conductors 94 and 96 can be selectively connected to Neutral I or II and Ground I or II. Connection can be made in the same manner as with Lines I–VI. That is, circuit selector clip 56 is placed on either terminal 114 or 116 of neutral and ground conductors 94 and 96 for respective connection to either Neutral I and Ground I or Neutral II and Ground II.

The above-described ability to utilize one conductor 54 for selective connection to either of two wires in the ten-wire system represents a cost savings over some conventional receptacle assemblies. Rather than needing one conductor for connection to each line, the present invention only needs one conductor for selective connection to two lines. Thus, the number of conductors required are cut in half and costs are reduced. It should be noted that this cost savings feature could be further extended to include more than two terminals per conductor so that the number of conductors required could be further reduced. The motivation for such an extension would be dictated by such factors as the number of wires in a power distribution system as well as the type of system (i.e., how many circuits and of what configuration).

Figure 5:
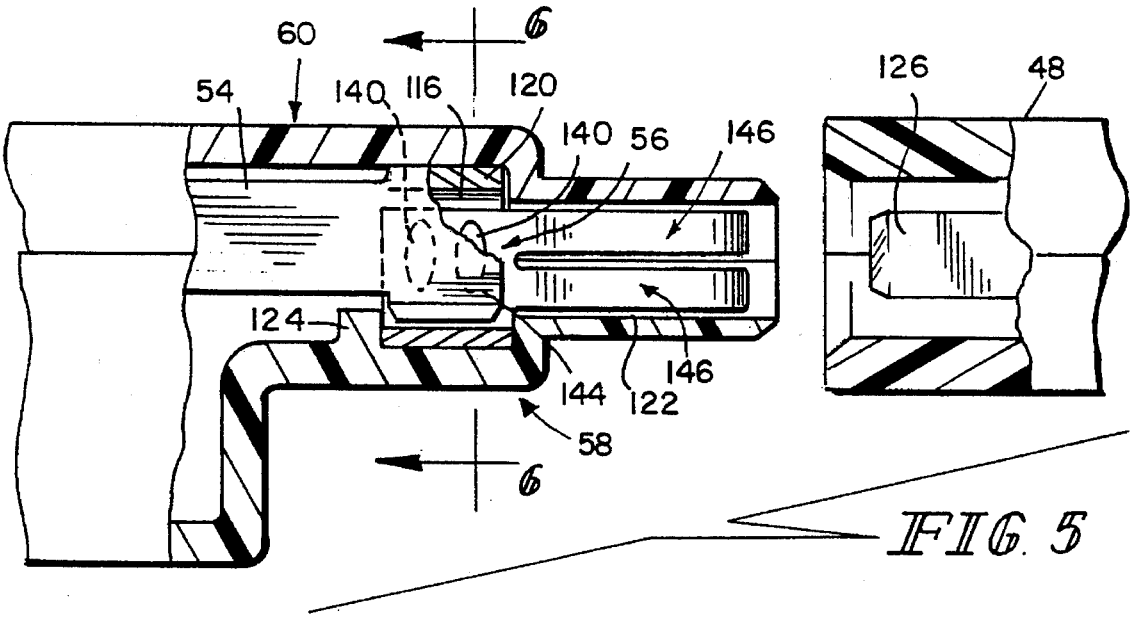
FIG. 5 shows a sectional view taken through a portion of the receptacle assembly, with portions broken away.

FIG. 5 shows a sectional view taken through a portion of receptacle assembly 30 and receptacle connector 48. FIG. 5 shows how receptacle assembly 30 is connected together. Circuit selector clip 56 is shown disposed on terminal 114. Also visible are one of the conductors 54, dimples 140, contact 116 and bridge 120. Retaining rib 124 is also shown immediately adjacent circuit selector clip 56 a portion of which is disposed in bay 122, as are terminals 114 and 116, and bridge 120. Rib 124 is present to retain clip 56 in bay 122 when male terminal 126 is inserted in fingers 146 thereof. Without rib 124 only dimples 140 would react to the force applied by male terminal 126. If sufficient force were applied by contact 126, clip 56 could dislodge from terminal 114 so that no electrical contact was made with the power distribution wire connected to male terminal 126. The presence of retaining rib 124 allows a portion of body 58 to abut thereagainst so that clip 56 will not be dislodged from terminal 114 when male terminal 126 is inserted.

Figure 6:
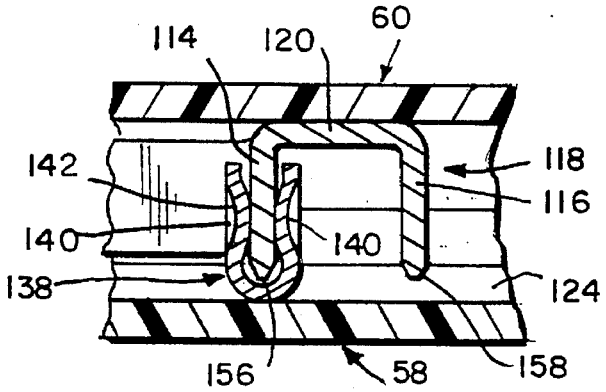
FIG. 6 shows a cross-sectional view taken along line 6—6 of FIG. 5.

FIG. 6 shows a portion of receptacle assembly 30 as seen along line 6—6 of FIG. 5. The selectable mounting alternative discussed above provided by circuit selector clip 56 on either terminal 114 or 116 is shown. Also shown is retaining rib 124, the function of which was described in the immediately preceding paragraph. Dimples 140 on sides 142 and 144 of the body 138 of circuit selector clip 56 are also visible. As can be seen, dimples 140 help secure clip 56 on terminal 114 and provide points of electrical contact between clip 56 and terminal 114. Finally, ends 58 of respective terminals 114 and 116 are shown. Ends 58 have angled portions formed thereon. This angling is present to aid in the insertion of body 138 of clip 56 on either terminal 114 or 116.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A receptacle assembly, comprising:

a body;

at least one outlet formed in the body for receiving an electrical plug, said outlet including a line terminal, a neutral terminal, and a ground terminal;

at least one input plug formed in the body, said input plug having a plurality of openings;

conductor means extending from each of said outlet terminals to said input plug, at least one of said conductor means terminating in a plurality of terminals positioned adjacent a respective plurality of openings of the input plug; and circuit selector means, connected to one of said plurality of terminals adjacent the openings of the input plug, for selectively extending said conductor means into a selected one of said plurality of openings.

2. The receptacle assembly of claim 1, wherein said plurality of terminals of said conductor means comprise male terminals.

3. The receptacle assembly of claim 2, wherein said circuit selector means comprises a clip having a female terminal on a first end thereof adapted to matingly engage the male terminals of the conductor means.

4. The receptacle assembly of claim 3, wherein said first end has anchoring means for securely engaging the male terminals of the conductor means.

5. The receptacle assembly of claim 4, wherein said anchoring means comprises dimples formed in said first end.

6. The receptacle assembly of claim 3, wherein said first end is substantially U-shaped in cross-section.

7. The receptacle assembly of claim 3, wherein said clip has a female terminal on a second end thereof adapted to matingly receive a male terminal of an input circuit.

8. The receptacle assembly of claim 7, wherein said body has retaining means against which a portion of the first end of the clip abuts to prevent said clip from being removed from a male terminal on which the clip is matingly engaged when the second end of said clip matingly receives the male terminal of the input circuit.

9. The receptacle assembly of claim 8, wherein said retaining means is a rib.

10. The receptacle assembly of claim 9, wherein said rib is formed on said body.

11. The receptacle assembly of claim 7, wherein said female terminals of the clip are substantially orthogonally oriented relative to one another.

12. The receptacle assembly of claim 7, wherein said second end of said clip comprises at least one pair of laterally opposed, biased fingers that are sprung toward one another to form a gap that slidingly and conductively receives therein said male terminal of said input circuit.

13. The receptacle assembly of claim 12, wherein ends of said fingers outwardly curve opposite one another and opposite the direction of bias of said fingers.

14. The receptacle assembly of claim 1, wherein each of said conductor means terminates in a plurality of terminals positioned adjacent respective ones of the plurality of openings of the input plug.

15. The receptacle assembly of claim 1, wherein said conductor means are made from one of brass and copper, and wherein said circuit selector means is made from high performance copper alloy.

16. The receptacle assembly of claim 1, wherein said receptacle assembly comprises two input plugs formed on opposite ends of said body, and wherein said conductor means extend from said outlet terminals to each of said input plugs, and wherein at least one of said conductor means terminates in a plurality of terminals adjacent a respective plurality of openings of at least one of said input plugs.

17. The receptacle assembly of claim 1, wherein each of said conductor means terminates in two terminals adjacent two of the openings of the input plug.

18. An assembly, comprising:

a receptacle including an outlet for receiving a first electrical plug and an input for receiving a second electrical plug;

a conductor disposed in the receptacle and coupled to the outlet, the conductor having first and second terminals; and a circuit selector disposed in the receptacle and selectively attachable to one of the first terminal of the conductor to electrically couple the conductor to a first contact point of the second plug and the second terminal of the conductor to electrically couple the conductor to a second contact point of the second plug.

19. The assembly of claim 18, wherein the first and second terminals of the conductor each include a male terminal portion and wherein a first end of the circuit selector includes a female terminal adapted to matingly engage the first and second male terminal portions of the conductor.

20. The assembly of claim 19, wherein the first end has anchoring means for securely engaging the first and second male terminal portions of the conductor.

21. The assembly of claim 20, wherein said anchoring means comprises dimples formed in the first end.

22. The assembly of claim 18, wherein the circuit selector includes a female terminal on a second end that includes at least one pair of laterally opposed, biased fingers that are sprung toward one another to form a gap that slidingly and conductively receives one of a first terminal of the second electrical plug located at the first contact point and a second terminal of the second electrical plug located at the second contact point.

23. The assembly of claim 22, wherein ends of said fingers outwardly curve opposite one another and opposite the direction of bias of said fingers.

24. The assembly of claim 18, wherein the conductor is made from one of brass and copper, and further wherein said circuit selector is made from a high performance copper alloy.

25. A receptacle assembly, comprising:

a body;

at least one outlet formed in the body for receiving an electrical plug;

at least one input plug formed in the body, said input plug having six line openings, two neutral openings, and two ground openings;

line conductor means connected to and extending from said outlet to said input plug, said line conductor means terminating in a plurality of terminals positioned adjacent a respective plurality of line openings;

neutral conductor means connected to and extending from said outlet to said input plug, said neutral conductor means terminating in two terminals positioned adjacent said two neutral openings;

ground conductor means connected to and extending from said outlet to said input plug, said ground conductor means terminating in two terminals positioned adjacent said two ground openings; and circuit selector means, connected to one of said plurality of terminals adjacent the line openings and connected to one of each of the two terminals adjacent both the neutral and ground openings, for selectively extending said line, neutral, and ground conductors into a selected one of said line, neutral, and ground openings.

26. The receptacle assembly of claim 25, wherein said line conductor means comprises three differently shaped line conductors, each of which terminates in two terminals positioned adjacent two of said six line openings.

27. The receptacle assembly of claim 26, wherein said receptacle assembly comprises two input plugs formed on opposite ends of said body, and wherein said line, neutral, and ground conductor means are connected to and extend from said outlet to each of said input plugs, and wherein each of said line, neutral, and ground conductor means terminates in two terminals adjacent respective line, neutral, and ground openings of at least one of said input plugs.

28. The receptacle assembly of claim 25, wherein said terminals of said line, neutral, and ground conductor means comprise male terminals.

29. The receptacle assembly of claim 28, wherein said circuit selector means .comprises clips having female terminals on first ends thereof adapted to matingly engage the male terminals of the line, neutral, and ground conductor means.

30. The receptacle assembly of claim 29, wherein said first ends have anchoring means for securely engaging the male terminals of the line, neutral, and ground terminal means.

31. The receptacle assembly of claim 30, wherein said anchoring means comprises dimples formed in said first ends.

32. The receptacle assembly of claim 29, wherein said first ends are substantially U-shaped in cross-section.

33. The receptacle assembly of claim 29, wherein said clips have female terminals on second ends thereof adapted to matingly receive male terminals of an input circuit.

34. The receptacle assembly of claim 33, wherein said female terminals on said first and second ends of each of said clips are substantially orthogonally oriented relative to one another.

35. The receptacle assembly of claim 33, wherein each of said second ends of said clips comprise at least one pair of laterally opposed, biased fingers that are sprung toward one another to form a gap that slidingly and conductively receives therein said male terminals of said input circuit.

36. The receptacle assembly of claim 35, wherein ends of said fingers outwardly curve opposite one another and opposite the direction of bias of said fingers.

37. The receptacle assembly of claim 25, wherein said line, neutral, and ground conductor means are made from one of brass and copper, and wherein said circuit selector means is made from high performance copper alloy.

38. A receptacle assembly, comprising:

a body;

at least one outlet formed in the body for receiving an electrical plug;

at least one input plug formed in the body, said input plug having four line openings, four neutral openings, and two ground openings;

line conductor means connected to and extending from said outlet to said input plug, said line conductor means terminating in a plurality of terminals positioned adjacent a respective plurality of line openings;

neutral conductor means connected to and extending from said outlet to said input plug, said neutral conductor means terminating in a plurality of terminals positioned adjacent a respective plurality of neutral openings;

ground conductor means connected to and extending from said outlet to said input plug, said ground conductor means terminating in two terminals positioned adjacent said two ground openings; and circuit selector means, connected to one of said plurality of terminals adjacent the line openings, connected to one of said plurality of terminals adjacent the neutral openings, and connected to one of the two terminals adjacent the ground openings, for selectively extending said line, neutral, and ground conductors into a selected one of said line, neutral, and ground openings.

39. The receptacle assembly of claim 38, wherein said line and neutral conductor means each comprises two differently shaped line and neutral conductors, each of which terminates in two terminals positioned adjacent two of said four respective line and neutral openings.

40. The receptacle assembly of claim 39, wherein said receptacle assembly comprises two input plugs formed on opposite ends of said body, and wherein said line, neutral, and ground conductor means are connected to and extend from said outlet to each of said input plugs, and wherein each of said line, neutral, and ground conductor means terminates in two terminals adjacent respective line, neutral, and ground openings of at least one of said input plugs.

41. The receptacle assembly of claim 38, wherein said terminals of said line, neutral, and ground conductor means comprise male terminals.

42. The receptacle assembly of claim 41, wherein said circuit selector means comprises clips having female terminals on first ends thereof adapted to matingly engage the male terminals of the line, neutral, and ground conductor means.

43. The receptacle assembly of claim 42, wherein said first ends have anchoring means for securely engaging the male terminals of the line, neutral, and ground terminal means.

44. The receptacle assembly of claim 43, wherein said anchoring means comprises dimples formed in said first ends.

45. The receptacle assembly of claim 42, wherein said first ends are substantially U-shaped in cross-section.

46. The receptacle assembly of claim 42, wherein said clips have female terminals on second ends thereof adapted to matingly receive male terminals of an input circuit.

47. The receptacle assembly of claim 46, wherein said female terminals on said first and second ends of each of said clips are substantially orthogonally oriented relative to one another.

48. The receptacle assembly of claim 46, wherein each of said second ends of said clips comprise at least one pair of laterally opposed, biased fingers that are sprung toward one another to form a gap that slidingly and conductively receives therein said male terminals of said input circuit.

49. The receptacle assembly of claim 48, wherein ends of said fingers outwardly curve opposite one another and opposite the direction of bias of said fingers.

50. The receptacle assembly of claim 38, wherein said line, neutral, and ground conductor means are made from one of brass and copper, and wherein said circuit selector means is made from high performance copper alloy.

51. A receptacle assembly, comprising:

at least one outlet for receiving a first electrical plug;

input means for receiving a second electrical plug;

conductor means connected to and extending from said outlet to said input means, said conductor means terminating in a terminal adjacent said input means; and circuit selector means attached to said terminal for connecting said conductor means to said input means, said circuit selector means having a female terminal on a first end thereof adapted to matingly receive a male terminal of an input circuit;

wherein said terminal of said conductor means comprises a male terminal and wherein a second end of said circuit selector means has a female terminal thereon adapted to matingly engage the male terminal of the conductor means, said second end having anchoring means that includes dimples formed in said second end for securely engaging the male terminal of the conductor means.

52. A receptacle assembly, comprising:

at least one outlet for receiving a first electrical plug;

input means for receiving a second electrical plug;

conductor means connected to and extending from said outlet to said input means, said conductor means terminating in a terminal adjacent said input means; and circuit selector means attached to said terminal for connecting said conductor means to said input means, said circuit selector means having a female terminal on a first end thereof adapted to matingly receive a male terminal of an input circuit, said female terminal on said first end including at least one pair of laterally opposed, biased fingers that are sprung toward one another to form a gap that slidingly and conductively receives therein said male terminal of said input circuit.

53. The receptacle assembly of claim 52, wherein ends of said fingers outwardly curve opposite one another and opposite the direction of bias of said fingers.

* * * * *